United States Patent [19]

Baker

[11] 3,996,686

[45] Dec. 14, 1976

[54] GEAR-DRIVEN DOUBLE-ACTION FIRING MECHANISM FOR FIREARMS

[75] Inventor: Richard L. Baker, Wallingford, Conn.

[73] Assignee: The Leisure Group, Inc., Los Angeles, Calif.

[22] Filed: Mar. 24, 1975

[21] Appl. No.: 561,249

Related U.S. Application Data

[63] Continuation-in-part of Ser. No. 526,719, Nov. 25, 1974.

[52] U.S. Cl. ..... 42/65; 42/69 R

[51] Int. Cl.[2] ..... F41C 19/00

[58] Field of Search ..... 42/65, 55, 69 R

[56] References Cited

UNITED STATES PATENTS

| | | | |
|---|---|---|---|
| 7,360 | 5/1850 | Chamberlain | 42/69 R |
| 189,387 | 4/1877 | Robbins | 42/69 R |
| 829,082 | 8/1906 | Murphy | 42/66 |
| 990,669 | 4/1911 | Rodehaver | 42/65 |
| 3,613,286 | 10/1971 | Mayer | 42/65 |

*Primary Examiner*—Charles T. Jordan
*Attorney, Agent, or Firm*—St. Onge Mayers Steward & Reens

[57] ABSTRACT

A firing mechanism in which the hammer and trigger are interconnected by gears, so that the hammer can be cocked and fired simply by pulling the trigger in what is commonly referred to as double-action. The hammer is mounted so that it can pivot independently of the gears in order to discharge a cartridge. A sear connects one of the gears to the hammer so that it can be cocked by means of the trigger and then released when the trigger is fully retracted. A safety feature is also provided by mounting the hammer so that it is normally out of alignment with the firing pin and, thereby, can not accidentally discharge the gun. However, when the trigger is pulled the hammer is shifted bodily to bring it into alignment with the firing pin.

6 Claims, 5 Drawing Figures

GEAR-DRIVEN DOUBLE-ACTION FIRING MECHANISM FOR FIREARMS

This application is a continuation-in-part of co-pending application, Ser. No. 526,719 filed Nov. 25, 1974.

BACKGROUND OF THE INVENTION

The present invention relates to firearms, and it relates more particularly to improvements in firing mechanisms therefor in which means are provided for cocking the hammer in double-action.

The use of gears for cocking a pivoted hammer is disclosed in an early U.S. patent to Chamberlain No. 7,360 dated May 14, 1850, in which a gear segment on the hammer engages a cocking gear, which in turn is pivoted by a pawl on the trigger as the trigger is retracted. When the trigger reaches the end of its rearward stroke, the pawl releases the cocking gear, permitting it to be rotted by the hammer under the pressure of the hammer spring. Even though the use of gears for cocking a gun by means of the trigger provides a much smoother and more uniform trigger-pull throughout the stroke of the trigger than can be obtained using more conventional systems, very few firearms have employed gears for cocking the hammer.

A primary object of the present invention is to provide an improved firing mechanism for firearms in which a pivoted hammer can be cocked by the trigger through a gear train in order to provide an easier and smoother pull during double-action.

It has also been proposed heretofore as disclosed in the U.S. Patent to Murphy No. 829,082 granted August 21, 1906 to mount the hammer on a member that is eccentrically pivoted on the frame of the gun in such a way that unless the trigger is pulled, the hammer is out of alignment with the firing pin, rendering it impossible to discharge a live cartridge in the chamber. However, when the trigger is pulled, the hammer is lowered bodily on the frame of the gun, bringing the striking portion of the hammer into alignment with the firing pin, so that when it is released by the trigger, it will strike the firing pin to fire the cartridge.

Another object of the invention is to provide an automatic hammer safety of this type in a firearm capable of firing either in single-action or in double-action.

SUMMARY OF THE INVENTION

Basically the invention resides in an improved firing mechanism for a firearm having a pivoted hammer and a trigger by which the hammer can be cocked and released for firing the gun in double-action, wherein a gear is mounted for pivotal movement both with the hammer and independently of it while meshing with a gear-segment on the trigger. A sear is provided either on the hammer itself or on the hammer gear in order to lock them together while the trigger is being retracted in double-action. Means are likewise provided for disconnecting the sear when the hammer is pivoted to a cocked position in order to let the hammer fall independently of the gears under the pressure of the hammer spring.

Another aspect of the invention resides in providing an automatic hammer safety in combination with a gear-driven firing mechanism. To this end the hammer is pivoted on one or more pivot plates which are connected to the hammer gear and pivot in unison with it. The pivot plates are desirably circular disks, which form trunnions for the hammer, and are eccentric to the hammer pin so that pivotal movement of the pivot plates moves the pivot point of the hammer with respect to the hammer pin, causing the hammer to be shifted bodily within the frame of the gun into and out of operative relationship with a cartridge in the chamber of the gun.

When the trigger is actuated during double-action, it rotates the hammer gear in order to cock the hammer, and at the same time the pivot plates shift the pivot point of the hammer so that the hammer is moved bodily from a position in which it is out of alignment with the firing pin or cartridge to an operative position in which it is in alignment therewith. Thus, when the hammer is released by the sear, it strikes the firing pin or cartridge to fire the gun. However, as will be more apparent from the description hereinafter, the gun can not be discharged unless the trigger is positively retracted in order to position the hammer in an operative position.

With the foregoing background and general summary of the invention in mind, reference is made to the accompanying drawings, which illustrate how firing mechanism of the present invention can be employed to great advantage in a revolver. It will be understood, however, that the basic invention is also applicable in all firing mechanisms regardless of the type of firearm, where a pivoted hammer is designed to be cocked in double-action by means of the trigger.

DETAILED DESCRIPTION OF THE PREFERRED EMBODIMENT

Figure 1:
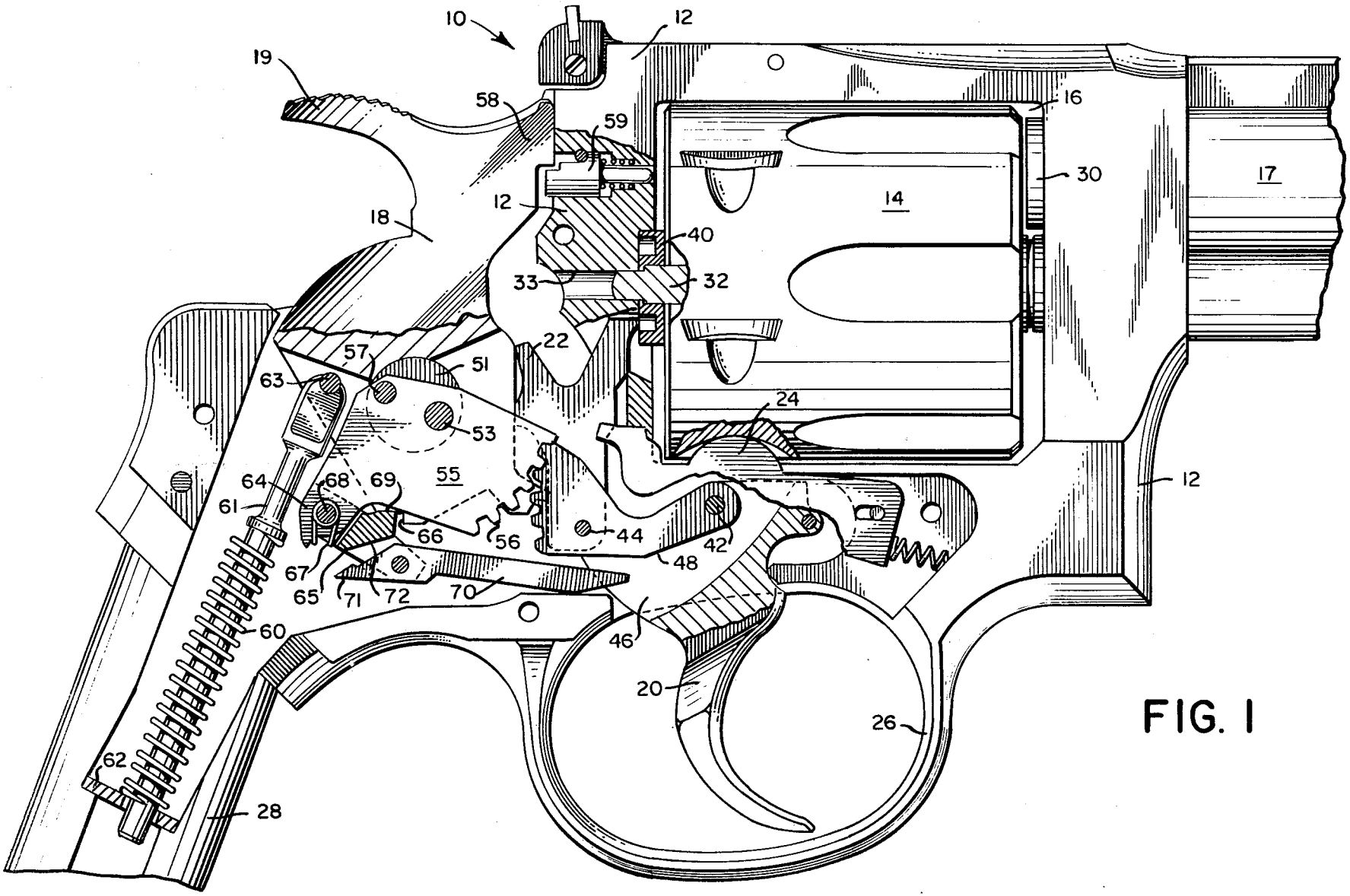
FIG. 1 is a side view, partially broken away and partially in section of a revolver incorporating the firing mechanism of the present invention.

The revolver 10 consists basically of a frame 12, a chamber cylinder 14 rotatably mounted in a central opening 16 of frame 12, a barrel 17, a hammer 18, a trigger 20, an indexing pawl or hand 22 and a cylinder lock 24. Frame 12 includes a trigger-guard 26 and a tang-portion 28, on which the grip (not shown) is fastened. Barrel 17 is rigidly mounted in the front of frame 12 and has rear extension 30 that projects a short distance into the central opening 16 into close proximity with the front end-wall of cylinder 14.

Cylinder 14 is mounted on a spindle 32, the rear end of which protrudes a short distance from the rear face of cylinder 14 for engagement within a hole 33 in frame 12. Spindle 32 extends forward from cylinder 14 below the barrel 17 and is journaled in a cylinder crane (not shown), by which it may be swung out laterally of frame 12 in order to reload the cylinder in the usual manner. A ratchet wheel 40 is mounted concentrically on cylinder 14 at its rear end for rotation therewith and has a plurality of radially disposed teeth which are engaged by the indexing hand 22 in sequence for rotating cylinder 14 in order to index the chambers one at a time into alignment with the barrel 17.

Figure 3:
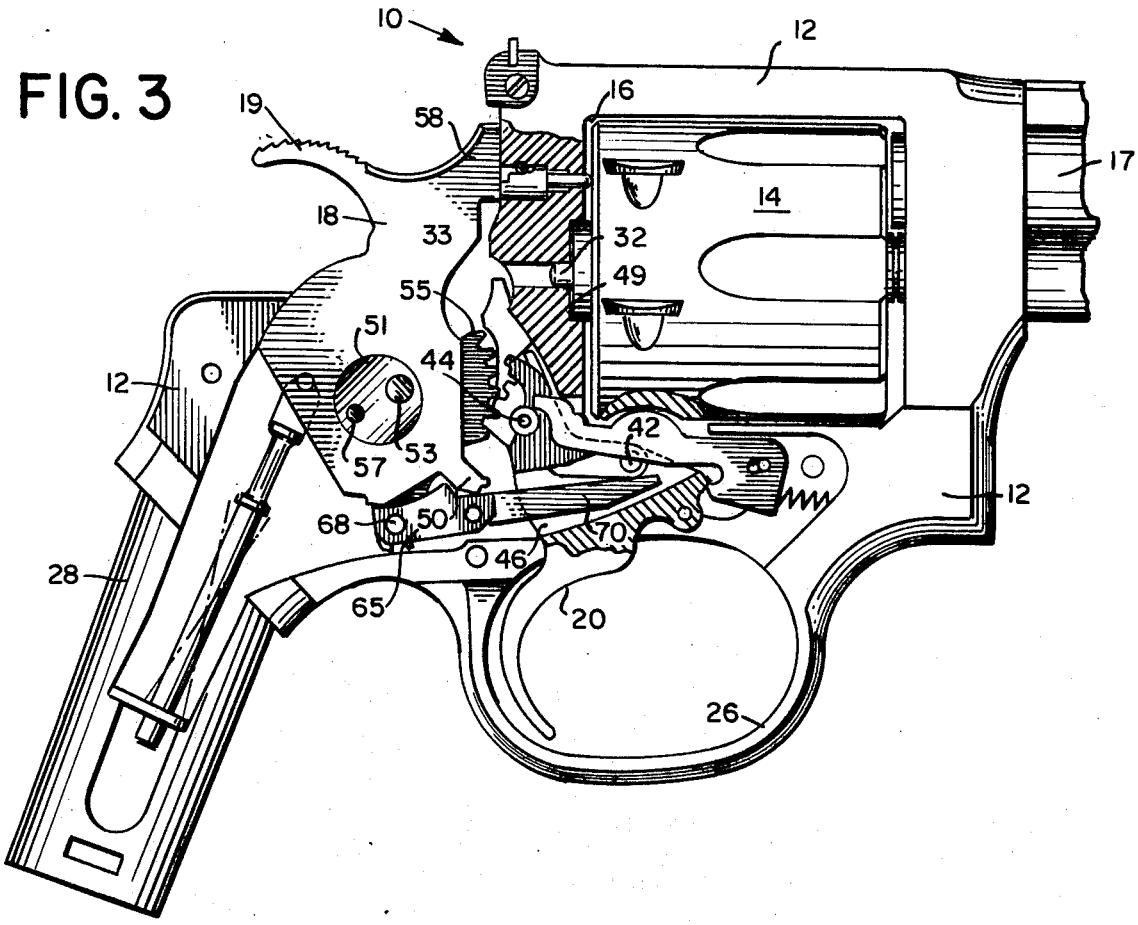
FIG. 3 is a view similar to FIG. 1, but on a smaller scale and showing the parts in the positions they assume at the instant the gun is fired.

Trigger 20 is pivoted on the frame 12 about a pivot pin 42 between its normal position of rest shown in FIG. 1 and retracted or fired position shown in FIG. 3. Cylinder hand 22 is pivotally connected at its lower end to a rearwardly and upwardly projecting portion 43 of trigger 20 by a pivot pin 44 and is resiliently urged forward at its upper end by means of a spring (not shown) for engagement of its nose 45 with ratchet 40. Each time trigger 20 is retracted, hand 22 indexes cylinder 14 to move the next chamber into line with the barrel where it is held by cylinder lock 24.

Figure 4:
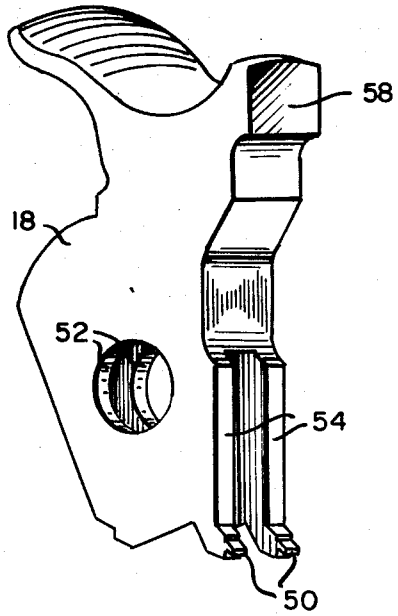
FIG. 4 is a perspective view of the hammer by itself.
Figure 5:
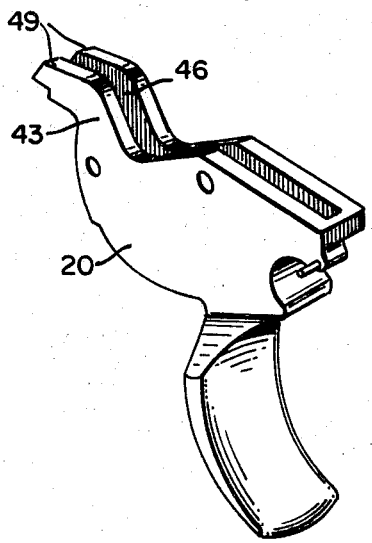
FIG. 5 is a perspective view of the trigger only.

As illustrated in FIG. 5, the upper portion of trigger 20 is centrally slotted at 46 to receive a gear-segment 48, which is rigidly fixed to the trigger by means of pins 42 and 44. One end of pin 44 projects through the far side of the trigger as viewed in the drawings into a hole at the lower end of cylinder hand 22, thereby pivotally connecting the hand 22 to trigger 20. The other pin 42 is the trigger pivot pin. A pair of conventionally shaped sear-noses 49 (FIGS. 3 and 5) is provided on the slotted rear extension 43 of trigger 20 cocking engagement with a corresponding pair of cocking feet 50 FIGS. 3 and 4) on hammer 18 for cocking the hammer in single-action in the usual manner.

Figure 2:
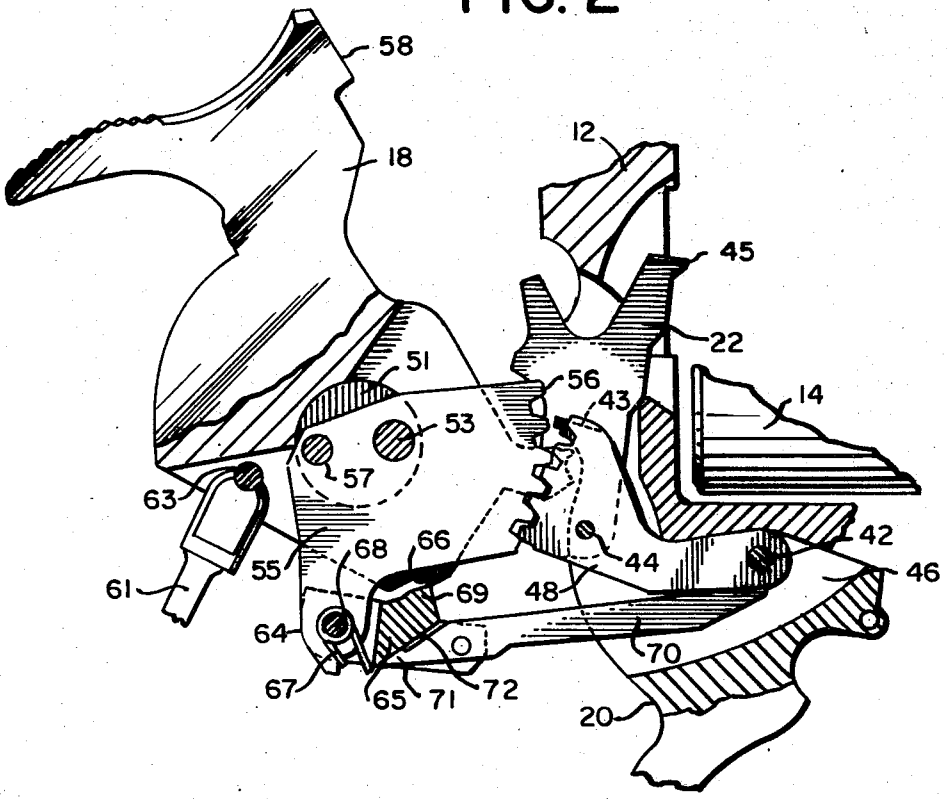
FIG. 2 is an elevational view of the firing mechanism of the revolver shown in FIG. 1 with the parts disposed in the positions they assume when the trigger nears the end of its stroke as it is being pulled during double-action, portions of the gun being shown broken away and partly in section.

Hammer 18 pivots between its cocked position shown in FIG. 2 and its fired position of FIG. 3, but instead of being journaled directly on the hammer pin in the conventional manner, is arranged to pivot on a pair of pivot plates 51, each of which in this instance consists of a circular disk forming a trunnion. Each disk 51 is received within one of a pair of enlarged circular openings 52, 52 (FIG.4) co-axially disposed in opposite sides of hammer 18, openings 52, 52 forming the bearing surfaces for the hammer as it pivots on being cocked and fired. Disks 51 in turn are pivoted eccentrically about a hammer pin 53 supported at both ends in frame 12. As best seen in FIGS. 1, 2 and 4, the lower portion of hammer 18 is centrally slotted in order to form depending, parallel side walls 54, 54, between which is slidably received a gear-plate 55 having a series of teeth 56 that mesh with the gear teeth on the trigger-segment 48.

Gear-plate 55 is rigidly fastened by means of a clevis pin 57 to the two eccentric disks 51 for pivotal movement therewith about hammer pin 53, the clevis pin 57 extending through gear-plate 55 with its ends engaging within holes in each of the eccentric disks 51. Accordingly, disks 51 and gear-plate 55 are movable as a unit about the hammer pin 53 between the position shown in FIG. 1, in which the pin 57 is located in an elevated position higher than the hammer pin 53 and the position shown in FIG. 3 where pin 57 is lower than the hammer pin 53. It is apparent therefore that in addition to pivoting about the eccentric disks 51, hammer 18 is also movable bodily relative to the hammer pin 53 and, therefore, to the frame 12. Thus, in the position shown in FIG. 1 the striking portion 58 of hammer 18 is disposed above, and consequently out of registry with, the firing pin 59, whereas in the position shown in FIG. 3, the hammer is lowered bodily within frame 12, so that the striking portion 58 is aligned with the firing pin for discharging a cartridge.

The main hammer spring 60 is held in compression between a shoulder on the hammer strut 61 and an apertured plate 62 seated within the tang portion 28 of frame 12, with the upper end of strut 61 bearing against a pin 63 on hammer 18 in the usual manner. As shown in FIG. 3, hammer 18 has just been driven by the main spring 60 from its cocked position into engagement with the firing pin 59 in order to fire the gun.

Pivoted to a projection 64 on the lower rear portion of gear-plate 55 is a sear lever 65 by which gear-plate 55 drivingly engages a sear notch 66 in the under edge of hammer 18 for cocking the hammer by means of the trigger in order to fire the gun in double-action. A torsion spring 67 urges sear lever 65 in a counterclockwise direction as viewed in the drawings about its pivot pin 68 toward engagement with wear notch 66 when both the hammer and the trigger are in their normal positions of rest as shown in FIG. 1.

Thus, when the trigger is pulled in double-action (i.e. without first cocking the hammer), trigger-segment 48 pivots gear-plate 55 counterclockwise, and since the nose 69 of sear lever 65 is resiliently held in engagement with sear notch 66, the hammer 18 is driven in the same direction until it reaches its cocked position (FIG. 2). At the same time counterclockwise movement of gear-plate 55 has pivoted eccentric disks 51 about hammer pin 53, lowering hammer 18 into alignment with the firing pin 59 so that when the hammer is released it will strike the firing pin.

An elongated finger 70 pivotally mounted on the front portion of sear lever 65 extends forward into the slot 46 in trigger 20 under the gear-segment 48. The rear end of finger 70 is formed in such a manner that it can pivot freely when the trigger is forward (FIG. 1), but is prevented from pivoting clockwise relative to sear lever 65 after the gear-plate 55 has been rotated far enough to bring a foot-portion 71 on finger 70 into contact with an abutment surface 72 on the sear lever 65. Thus, as illustrated in FIG. 2 where the sear lever 65 has been moved forward as the trigger is retracted, the foot-portion 71 is shown engaging the surface 72 so that finger 70 is lifted into contact at its free end with the under edge of gear-segment 48. Continued movement of gear-plate 55 as trigger 20 is retracted causes the sear lever 65 to be pivoted clockwise about its pivot pin 68 to the position shown in FIG. 2 where the sear nose 69 is on the point of releasing the hammer. Any further retraction of the trigger will move the sear nose 69 clear of notch 66 allowing the hammer 18 to fall under the pressure of the main spring 60, and the parts will then assume the position shown in FIG. 3.

Operation of the gun in single-action is similar to that of a conventional revolver firing mechanism except that when the hammer is retracted by the thumb-piece 19, it is simultaneously lowered from its safe position (FIG. 1) into alignment with the firing pin 59. Thus, as the hammer is pivoted counterclockwise, the cocking feet 50 engage the under edges of the trigger-extension 43, pivoting trigger 20 clockwise, so that trigger gear-segment 48 then pivots gear-plate 55 and eccentric disks 51 counterclockwise. Such pivotal movement of eccentric disks 51 results in the point about which hammer 18 pivots being lowered to bring the striking portion 58 of the hammer into alignment with the firing pin. When the hammer is fully cocked by engagement of its cocking feet 50 with the sear-noses 49 on trigger-extension 43, trigger 20 is partially retracted in a cocking position, so that when it is pulled to fire the gun, the hammer will be released in the usual manner.

It will also be noted that during firing, the hammer is held in its lowered position for alignment of its striking nose 58 with the firing pin until the trigger is released.

However, if the hammer is accidentally jarred out of cocking engagement with the sear-noses 49, as for example if the revolver is inadvertently dropped, the trigger will be immediately returned to its forward-most position by the pressure of the main spring 60 on hammer 18, causing the hammer to be lifted to its inoperative position out of alignment with the firing pin. The gun can therefore be fired only when the trigger has been intentionally pulled.

From the foregoing, it will be apparent that the hammer is lowered and raised into and out of alignment with the firing pin by means of eccentric disks 51, which in turn for all practical purposes form part of the gear-plate 55 and, therefore, pivot in one direction or the other in direct conjunction with the movement of the trigger. Consequently, whether the hammer is retracted by the thumbpiece 19 in single action firing or by the trigger in doubleaction, trigger 20 is moved by a predetermined amount corresponding to the amount of movement of the hammer. Furthermore, retraction of the trigger, whether directly by the shooter's trigger finger or indirectly on manually cocking the hammer, results in a corresponding movement of gear-plate 55 so that eccentric disks 51 lower the hammer into alignment with the firing pin. On the other hand, unless the trigger is actually intentionally pulled in order to fire the gun, there is no way that the gun can be discharged.

For example, if the hammer should accidentally fall during single-action while being cocked or by being jarred out of cocking engagement with the trigger, the pressure of the main spring 60 on the hammer immediately pivots the eccentrics 51 clockwise until the trigger 20 returns to its forward position before the hammer can strike the firing-pin. Likewise, if the hammer accidentally receives a forwardly directed blow when it is in its uncocked position, there is no danger whatsoever that a live cartridge in the cylinder 14 can be discharged, due to the fact that the hammer is out of alignment with the firing pin 59.

Another advantage of eccentrically mounting the hammer is that the trigger is constantly urged forward by the hammer spring 60 through gear-plate 55 and gear-segment 48, thereby eliminating the need for a separate trigger-return spring.

What is claimed is:

1. In a firing mechanism for a firearm having a frame, a hammer member mounted on a hammer pin in said frame for pivotal movement between cocked and fired positions, and a hammer spring urging said hammer member into its fired position and a trigger mounted on said frame for cocking and releasing said hammer member, the improvement comprising in combination therewith, a gear member pivoted on said hammer pin for pivotal movement independently of said hammer pin, a gear-segment on said trigger meshing with said gear member for pivoting said gear member on manipulation of said trigger, a sear mounted on one of said hammer and gear members for cocking engagement with the other, and means for disengaging said sear from cocking engagement with said other member when said hammer member has been pivoted to a cocked position on retraction of said trigger in order to let said hammer member fall independently of said gear member under the pressure of said hammer spring.

2. A firing mechanism as defined in claim 1, wherein said hammer is provided with a sear notch and said sear is mounted on said gear member for movement into and out of engagement with said sear notch, said means for disengaging said sear comprising a finger on said sear disposed for movement with said gear member into engagement with an abutment surface for displacing said sear from engagement with said sear notch when said gear member is pivoted by said trigger through a predetermined arc.

3. A firing mechanism as defined in claim 2, wherein said sear is pivotally mounted on said gear member, said finger being pivoted to said sear for limited pivotal movement with respect thereto.

4. A firing mechanism as defined in claim 1, which further includes a pivot plate rigid with said gear member for pivotal movement in unison therewith about said hammer pin and forming a trunnion on which said hammer member is mounted, said trunnion being eccentric to said hammer pin such that pivotal movement of said pivot plate causes said hammer member to be shifted bodily relative to said hammer pin into and out of operative relationship with a cartridge to be fired.

5. A firing mechanism as defined in claim 4, wherein a pair of said pivot plates are provided on opposite sides of said gear member, said pivot plates comprising circular disks each forming a said trunnion, said hammer pin extending through said pivot plates and said gear member, and said pivot plates being fixed respect to said gear member by means of a clevis pin extending through said pivot plates and gear member at a point spaced from said hammer pin.

6. A firing mechanism as defined in claim 4, wherein said hammer member is provided with a cocking foot for cocking said hammer member in single-action and said trigger is provided with a sear-nose disposed for interengagement with said cocking foot on said hammer member such that when said hammer member is cocked in single action said cocking foot engages said sear-nose to pivot said trigger to a cocking position simultaneously pivoting said gear member and pivot plate in order to shift said hammer member into said operative relationship.

* * * * *

UNITED STATES PATENT OFFICE

CERTIFICATE OF CORRECTION

Patent No. 3,996,686 Dated December 14, 1976

Inventor(s) Richard L. Baker

It is certified that error appears in the above-identified patent and that said Letters Patent are hereby corrected as shown below:

Column 5, line 55, "movement independently of said hammer pin" should read -- movement independently of said hammer member -- .

Column 6, line 42, "pivot plates being fixed respect" should read -- pivot plates being fixed with respect -- .

Signed and Sealed this

Fifteenth Day of February 1977

[SEAL]

*Attest:*

RUTH C. MASON
*Attesting Officer*

C. MARSHALL DANN
*Commissioner of Patents and Trademarks*